United States Patent [19]

Trader

[11] 4,213,314

[45] Jul. 22, 1980

[54] HANDBAG LOCK

[76] Inventor: David A. Trader, 11308 Dockside Cir., Reston, Va. 22091

[21] Appl. No.: 973,729

[22] Filed: Dec. 27, 1978

[51] Int. Cl.[2] ..... E05B 67/38

[52] U.S. Cl. ..... 70/68

[58] Field of Search ..... 70/68, 207, 69; 16/114 R

[56] References Cited

U.S. PATENT DOCUMENTS 2,310,627 2/1943 Greene ..... 70/68

FOREIGN PATENT DOCUMENTS 404782 1/1934 United Kingdom ..... 70/68

*Primary Examiner*—Robert L. Wolfe

*Attorney, Agent, or Firm*—Shlesinger, Arkwright, Garvey & Dinsmore

[57] ABSTRACT

A locking device for a handbag in which one end of the carry strap has a lock bolt thereon which inserts into a lock attached to the handbag adjacent one end of the handbag's access opening and in which the opening for access into the handbag has a slide fastener with an annular handle through which the lock bolt may be passed when being inserted into the lock to lock closed the handbag.

19 Claims, 5 Drawing Figures

28
32
40
38
22
18
16
30
24
36
34
26
20
58
42
52
10
12
14
48
46
56
50
44
54

HANDBAG LOCK

BACKGROUND OF THE INVENTION

This invention concerns the securing of portable or hand carriable receptacles, particularly handbags and the like, and specifically deals with the locking system for handbags.

Money and other valuables often being carried in handbags it has long been a goal to provide adequate means for securing handbags to prevent their theft of the theft of their contents. Many handbag structures and attachable devices have been devised for this purpose.

A common approach used with slide fasteners involves providing a locking system for the slide when it is in the closed position two examples of which are shown by U.S. patents to Greene, U.S. Pat. Nos. 2,310,627, and to Edwards, 3,955,842.

The U.S. patent to Armistead, U.S. Pat. No. 2,707,010, shows a different securing mechanism for a plurality of slide fasteners in which each of the slide handles has a ring attached to it adapted to fit over a post when each slide fastener is in the closed position. A chain is then drawn through openings through the posts. The chain when secured prevents the rings from coming off the posts.

Another approach specifically designed for kit bags combines a securing device which also functions as a handle to carry the bag as shown in the U.S. patent to O'Connor, U.S. Pat. No. 2,324,638. Here the open mouth of the bag is pinched between two elongated members.

SUMMARY OF THE INVENTION

An object of this invention is to provide a locking device for a portable receptacle such as a handbag which may be secured by placing and locking its strap about a fixed object.

Another object of this invention is to provide a locking device for a longitudinally traveling closing element used to close and open a portable receptacle.

A further object of the invention is to provide a portable receptacle with a securing system by which the receptacle itself may be locked to a fixed object, the receptacle's opening may be locked closed or both.

An object of the invention is to provide a locking device for a portable receptacle in which one locking mechanism provides two locking functions simultaneously, locking the receptacle to a fixed object while also locking the receptacle's opening closed.

Another object of the invention is to provide a locking device for a portable receptacle which makes use of the receptacle's own handle to secure the receptacle.

A further object of the invention is to provide a portable receptacle in which one locking mechanism acts as the support means for one end of the receptacle's strap and as a dual purpose locking mechanism.

The invention is a locking device for a receptacle having an elongated opening defining first and second ends for access into the receptacle and an elongated carry memeber, the locking device comprising a closing mechanism for the receptacle opening including a longitudinally traveling fastening element for interengaging the opposing sides of the receptacle. opening, the fastening element having a handle thereon for gripping the fastening element. The closing mechanism is arranged so that the receptacle opening is closed when the fastening element is at the first end of the receptacle opening.

The fastening element handle has an opening therein. The carry member has two ends, a first end having an engagement member thereon and a second end permanently attached to the receptacle. An engaging and locking mechanism is connected to the receptacle adjacent the first end of the receptacle opening for engaging and locking the engagement member and the engagement member and the fastening element handle are adapted so that the engagement member may be passed through the handle opening to hold the handle in position when the engaging and locking mechanism engages and locks the engagement member.

DETAILED DESCRIPTION

Figures 1, 2, 3, 4, 5:
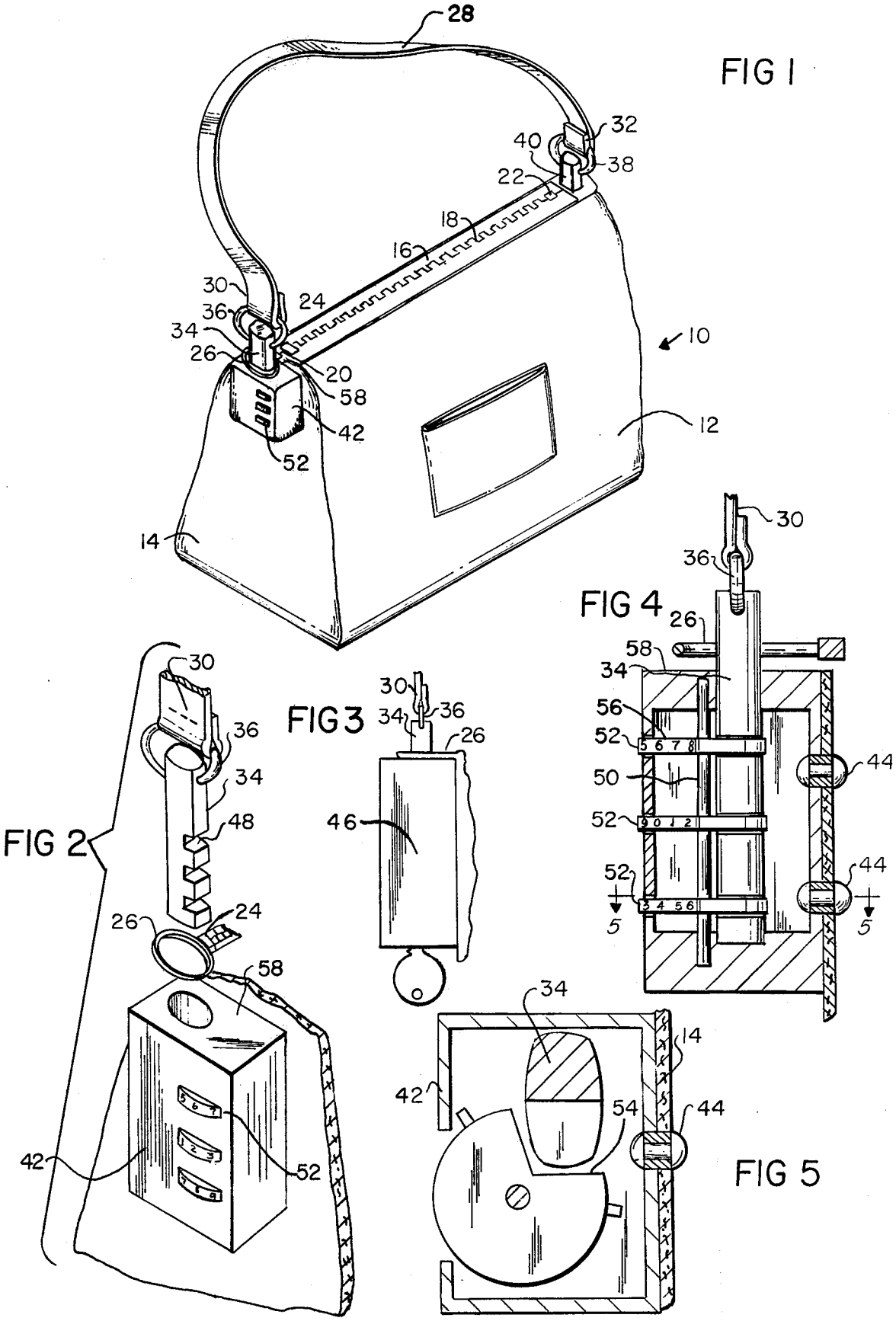
FIG. 1 is a perspective view of a handbag embodying the invention.
FIG. 2 is an exploded fragementary perspective view of the corner of the handbag of FIG. 1 having the lock thereon.
FIG. 3 is a front elevational view showing an alternative lock mechanism.
FIG. 4 is an enlarged sectional view of the lock of FIG. 1.
FIG. 5 is a sectional view taken along the line 5—5 of FIG. 4.

Referring to the figures, the handbag 10 is made from a flexible material and has side panels 12, end panels 14 and a bottom, not shown. The side panels 12 incline toward one another and terminate in a generally planar top 16. Running from end to end along the top 16 is an opening 18 by which access to the interior of the handbag 10 is provided. The opening 18 is elongated having a first end 20 and second end 22 and a slide fastener mechanism lying generally in the plane of the top 16 by which the opening 18 may be opened or closed. The slide fastener includes two strips of interengaging beads situated on the opposing sides of the opening 18 and a longitudinally traveling fastening element 24 which interengages or disengages the fastener beads to open or close the opening 18. The slide fastener is arranged so that the opening 18 is closed when the fastening element 24 is at one end of its path of travel at the first end 20 of the opening 18 and open when the fastening element 24 is at the second end 22 of the opening 18. The fastening element 24 has a handle 26 thereon which is gripped to manipulate the fastening element 24. The handle 26 is pivotally mounted on the fastening element 24. The handle 26 is an annular member or ring. Any handle 26 may be used which has an opening therein.

The handbag 10 also includes a carry member or strap 28 which is also made from a flexible material. The strap 28 has two ends 30, 32. The first end 30 has an engagement member or lock bolt 34 thereon to which it is connected by a ring 36 which lies in the plane of the strap 28 adjacent the bolt 34. The strap ring 36 passes through a passage in the head of the bolt 34. The second end 32 of the strap 28 has a second strap ring 38 thereon with which it is connected to a post 40 anchored to the handbag 10 and located in the top 16 of the handbag 10 adjacent the second end 22 of the handbag opening 18. The second strap end 32 is thus permanently attached to the handbag 10 at a point on the handbag 10 spaced from the first end 20 of the opening 18 and the opening 18 extends from its first end 20 toward the second end 32 of the strap 28.

A lock 42 is connected to the handbag 10 by bolts 44 adjacent the first end 20 of opening 18 for engaging and locking the lock bolt 34. The lock 42 may be a combination lock as shown in FIGS. 1, 2, 4 and 5 or a key operated lock 46 as shown in FIG. 3.

With reference to FIGS. 2, 4 and 5 the lock bolt 34 has a series of transverse grooves or notches 48. The mechanism of the lock 42 includes a shaft 50 upon which lock dials 52 are mounted and about which they rotate. Each lock dial 52 which is a generally circular disk has a sector 54 removed therefrom and has about its perifery numerals 56 which are positioned so that when the correct combination is dialed the sectors 54 of the respective dials 52 will line up permitting the removal or insertion of the lock bolt 34.

The lock 42 has a generally planar top surface 58 at which the lock bolt 34 is inserted into the lock 42 at an angle generally perpendicular thereto. The lock top surface 58 lies generally parallel to and adjacent the plane of the handbag top 16. The pivotally mounted fastening element handle 26 is adapted so that when the fastening element 24 is in the closed position the handle 26 may lie upon the top planar surface 58 of the lock 42.

In use the strap 28 is engaged at its first end 30 in the lock 42 using the bolt 34 and when so connected can be used to carry the handbag 10 as one normally would. However, the strap end 30 being detachable, the handbag 10 can be secured about any fixed object if it is to be left unattended by simply disengaging the bolt 34, placing the strap 28 about the object and relocking the bolt 34 in place.

Whether the strap 28 is so used or not, the lock 42 and bolt 34 arrangement may be used to lock closed the handbag opening 18. The opening in the fastening element handle 26 and the lock bolt 34 have cross sectional areas adapted so that the handle 26 fits onto the bolt 34. With the fastening element 24 in the closed position at the first end 20 of the opening 18, the handle 26 is placed on the top surface 58 of the lock 42 over the inlet into the lock interior and the lock bolt 34 is passed through the handle opening and is inserted and locked in place in the lock 42. The handle 26 and the fastening element 24 are thus held and locked in the closed position. To prevent the handle 26 from traveling along the strap 28 and thus permitting the opening of the handbag 10 without disengaging the bolt 34 and lock 42, the strap 28 has at its end 30 or the bolt 34 has a retaining structure to prevent this. In the embodiment shown the strap ring 36 has a width or diameter greater than the fastening element handle opening and thus acts to hold the handle 26 in position.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What I claim is:

1. A locking device for a receptacle having an elongated opening defining first and second ends for access into said receptacle and an elongated carry member, said locking device comprising:

means for closing said receptacle opening, said closing means including a longitudinally traveling fastening element for interengaging the opposing sides of said receptacle opening, said fastening element having a handle thereon for gripping said fastening element, said closing means being arranged so that said receptacle opening is closed when said fastening element is at said first end of said receptacle opening;

said handle having an opening therein;

said carry member having two ends, a first end having an engagement member thereon and second end permanently attached to said receptacle; and, engaging and locking means connected to said receptacle adjacent said first end of said receptacle opening for engaging and locking said engagement member of said carry member, said engagement member and said handle being adapted so that said engagement member may be passed through said handle opening to hold said handle in position when said engaging and locking means engages and locks said engagement member.

2. A locking device according to claim 1 wherein said receptacle is a handbag.

3. A locking device according to claim 1 wherein said carry member is a flexible strap.

4. A locking device according to claim 1 wherein said second end of said carry member is permanently attached to said receptacle at a point on said receptacle spaced from said first end of said receptacle opening.

5. A locking device according to claim 4 wherein said receptacle opening extends from its first end toward said second end of said carry member.

6. A locking device according to claim 1 wherein said engaging and locking means is a combination lock.

7. A locking device according to claim 1 wherein said engaging and locking means is a key operated lock.

8. A locking device according to claim 1 wherein said closing means is a slide fastener.

9. A locking device according to claim 1 wherein said fastening element handle is an annular member.

10. A locking device according to claim 1 wherein said fastening element handle is a ring.

11. A locking device according to claim 1 wherein said engagement member of said carry member includes a bolt adapted to be inserted in said engaging and locking means.

12. A locking device according to claim 11 wherein said fastening element handle is a ring and the cross sectional areas of said bolt and the opening of said ring are adapted so that said ring fits onto said bolt.

13. A locking device according to claim 1 wherein said engagement member of said carry member includes a retaining means for holding said fastening element handle in position by preventing it from traveling along said carry member.

14. A locking device according to claim 11 wherein said engagement member of said carry member includes a retaining means for holding said fastening element handle in position by preventing it from traveling along said carry member

15. A locking device according to claim 14 wherein said carry member is a strap and said retaining means is a ring positioned on said strap in the plane of said strap adjacent said bolt, said ring having a greater width than said fastening element handle opening whereby said handle is prevented from traveling past said ring along said strap.

16. A locking device according to claim 11 wherein said closing means is a slide fastener lying generally in the plane of the top of said receptacle, said engaging and locking means includes a generally planar surface at which said bolt is inserted into said engaging and locking means at an angle generally perpendicular to said planar surface, said planar surface lying generally parallel to and adjacent the plane of the top of said receptacle, and said fastening element handle is an annular member pivotally connected to said fastening element and adapted to lie on said planar surface of said engaging and locking means so that said bolt may pass through said annular handle to hold said handle in position when said engaging and locking means engages and locks said bolt.

17. A locking device for a handbag having a carry strap and an elongated opening defining first and second ends for access into said handbag, said locking device comprising:

a slide fastener for closing said handbag opening by interengaging the opposing sides of said handbag opening, said slide fastener including a longitudinally traveling fastening element having a handle thereon for gripping said fastening element, said slide fastener being arranged so that said handbag is closed when said fastening element is at said first end of said handbag opening;

said handle comprising an annular member pivotally connected to said fastening element;

said strap having two ends, a first end having a bolt thereon and a second end permanently attached to said handbag; and, a lock connected to said handbag adjacent said first end of said handbag opening for engaging and locking said strap bolt, said bolt and said annular fastening element handle being adapted so that said bolt may be passed through said annular fastening element handle to hold said handle in position when said lock engages and locks said bolt.

18. A locking device according to claim 1 wherein said receptacle is a hand carriable receptacle.

19. A locking device according to claim 5 wherein said second end of said receptacle opening is adjacent said point on said receptacle where said second end of said carry member is attached to said receptacle.

* * * * *